US012228012B2

(12) United States Patent
Alghamdi et al.

(10) Patent No.: US 12,228,012 B2
(45) Date of Patent: Feb. 18, 2025

(54) METHODS AND SYSTEMS FOR OPENING A SUBSURFACE SAFETY VALVE

(71) Applicant: SAUDI ARABIAN OIL COMPANY, Dhahran (SA)

(72) Inventors: Ali S. Alghamdi, Jeddah (SA); Anas E. Alturaysh, Jeddah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 94 days.

(21) Appl. No.: 18/051,395

(22) Filed: Oct. 31, 2022

(65) Prior Publication Data

US 2024/0141752 A1 May 2, 2024

(51) Int. Cl.
*E21B 34/14* (2006.01)
*E21B 33/072* (2006.01)

(52) U.S. Cl.
CPC ..... *E21B 34/14* (2013.01); *E21B 33/072* (2013.01); *E21B 2200/05* (2020.05)

(58) Field of Classification Search
CPC .... E21B 34/14; E21B 2200/05; E21B 34/142; E21B 33/072; F16K 35/06
See application file for complete search history.

(56) References Cited

U.S. PATENT DOCUMENTS 1,414,207 A * 4/1922 Reed ..... E21B 17/06 403/324
4,440,231 A * 4/1984 Martin ..... E21B 43/10 166/373
4,495,073 A * 1/1985 Beimgraben ..... B01D 35/02 166/227
6,598,685 B1 * 7/2003 Mashburn ..... E21B 27/005 166/227
7,252,149 B2 * 8/2007 Crow ..... E21B 34/102 166/373
7,775,269 B2 8/2010 Dennistoun et al.
10,745,997 B2 8/2020 Burris et al.
2003/0221844 A1 * 12/2003 Dallas ..... E21B 33/072 166/85.1
2010/0006296 A1 * 1/2010 Anderson ..... E21B 34/102 166/373
2010/0294376 A1 * 11/2010 O'Brien ..... E21B 23/04 137/12
2013/0043044 A1 * 2/2013 Garber ..... E21B 21/106 166/325
2018/0340397 A1 * 11/2018 Lake ..... E21B 34/066

FOREIGN PATENT DOCUMENTS

EP 1 809 860 B1 5/2010
EP 2 118 439 B1 1/2012
GB 2538358 A * 11/2016 ..... E21B 17/06

* cited by examiner

*Primary Examiner* — Blake Michener
(74) *Attorney, Agent, or Firm* — Osha Bergman Watanabe & Burton LLP

(57) ABSTRACT

A flapper holder tool may have a tubular body defining a bore extending a length from a first end to a second end. Additionally, a lip may extend radially outward at the first end. Further, an internal fish neck may be provided on an inner surface of the tubular body. The second end of the tubular body may be configured to engage a flapper of a tubing-retrievable subsurface safety valve.

17 Claims, 17 Drawing Sheets

METHODS AND SYSTEMS FOR OPENING A SUBSURFACE SAFETY VALVE

BACKGROUND

In the oil and gas industry, operations may be performed in a wellbore at various depths below the surface with downhole tools. A tubing-retrievable subsurface safety valve (TRSSSV) may be run in the wellbore as a part of a production tubing string to provide emergency closure of the producing conduits in the event of an emergency. The TRSSSV is designed to be fail-safe, so that the wellbore is isolated in the event of any system failure or damage to the surface production-control facilities. For example, the TRSSSV may be used as a primary isolation barrier for hydrocarbon production and may also be used as an isolation barrier when installing components in or performing maintenance on the well while running-in-hole (RIH) or pulling out-of-hole (POOH).

The downhole tools may require maintenance/repair or replacement, or become stuck, even when preventive measures are taken. Well intervention operations are conducted for removing downhole tools from the wellbore. A wireline, slickline, or coiled tubing may be sent into the wellbore to retrieve the downhole tools. In some cases, when RIH or POOH the wireline, slickline, or coiled tubing, a flapper of the TRSSSV may be closed against the wireline, slickline, or coiled tubing. Lengthily time-consuming downhole operations are conducted to open the flapper and release the wireline, slickline, or coiled tubing. However, if the flapper fails to open, conventional methods require cutting the wireline, slickline, or coiled tubing downhole, retrieving the TRSSSV, fishing out the downhole tools, and then resetting the TRSSSV. In such an event, non-productive time (NPT) may increase in addition to possible equipment damage, hazardous work environment, and total well loss.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a method for a well intervention operation on a wellbore having a tubing-retrievable subsurface safety valve (TRSSSV) in a tubular string therein extending into the wellbore from a wellhead. The method may include deploying a flapper holder tool into the wellbore; landing a lip of the flapper holder tool within the TRSSSV; forcing a flapper of the TRSSSV with a tubular body of the flapper holder tool from a closed position to an open position; and conducting the well intervention operation.

In another aspect, the embodiments disclosed herein relate to a flapper holder tool. The flapper holder tool may include a tubular body defining a bore extending a length from a first end to a second end; a lip extending radially outward at the first end; and an internal fish neck provided on an inner surface of the tubular body. The second end of the tubular body may be configured to engage a flapper of a tubing-retrievable subsurface safety valve.

In yet another aspect, the embodiments disclosed herein relate to a system with a wellhead on a surface of a wellbore and a blowout preventer is disposed on top of the wellhead. The system may also include a tubing string disposed within the wellbore; a cable extending downward into the wellbore from the blowout preventer and the wellhead, the cable is connected to a bottomhole assembly within the wellbore; a tubing-retrievable subsurface safety valve disposed in the tubing string; and a flapper holder tool attached to the cable. The flapper holder tool may include a tubular body defining a bore extending a length from a first end to a second end; and a lip extending radially outward at the first end configured to land within the tubing-retrievable subsurface safety valve. The second end of the tubular body may be configured to force a flapper of the tubing-retrievable subsurface safety valve to move from a closed position to an open position.

Other aspects and advantages will be apparent from the following description and the appended claims.

BRIEF DESCRIPTION OF DRAWINGS

Embodiments of the present disclosure will now be described in detail with reference to the accompanying Figures. Like elements in the various Figures may be denoted by like reference numerals for consistency.

DETAILED DESCRIPTION

Figure 1:
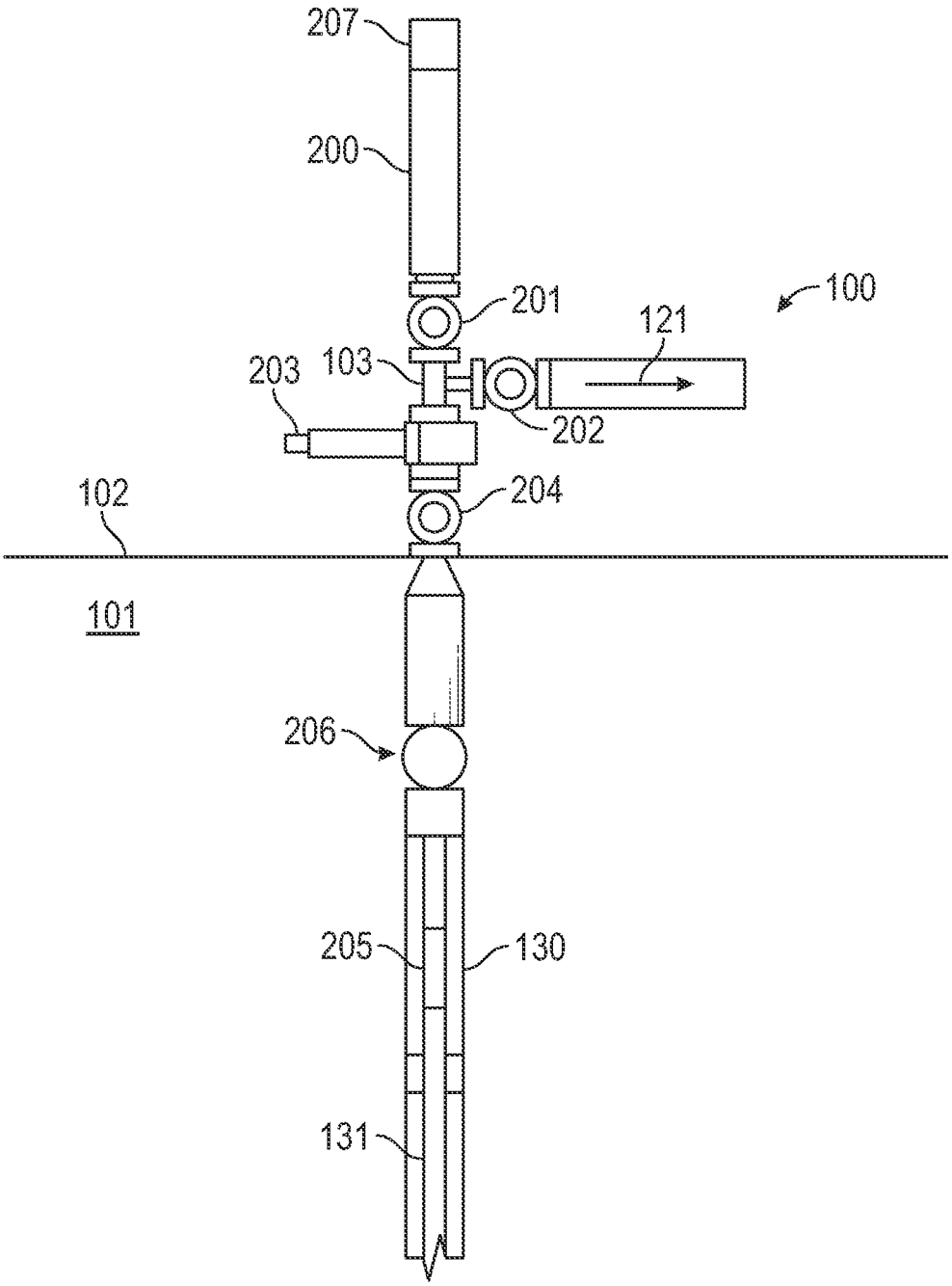
FIG. 1 illustrates a well system in accordance with one or more embodiments.

In the following detailed description of embodiments of the present disclosure, numerous specific details are set forth to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" "attached" or "attached to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification. In addition, any terms designating tubular (i.e., a length of pipe that provides a conduit for flow therein) should not be deemed to limit the scope of the disclosure. The embodiments are described merely as examples of useful applications, which are not limited to any specific details of the embodiments herein.

Embodiments disclosed herein relate generally to well intervention operations in oil and gas well sites. More specifically, embodiments disclosed herein relate to systems and methods for using a flapper holder tool to open a tubing-retrievable subsurface safety valve (TRSSSV) of a tubing string. In one aspect, embodiments disclosed herein pertain to when the TRSSSV fails to open or unintentionally closes, the flapper holder tool is used to open the TRSSSV to allow operations to continue, such as, running or pulling out tools safely through the failed TRSSSV.

FIG. 1 shows a block diagram of a well site 100 in accordance with one or more embodiments. The well site 100 includes a wellbore 130 in fluid communication with a hydrocarbon reservoir ("reservoir") located in a subsurface formation ("formation") 101. The formation 101 may include a porous formation that resides underground, beneath the Earth's surface 102. The formation 101 and the reservoir may include different layers of rock having varying characteristics, such as varying degrees of permeability, porosity, capillary pressure, and resistivity. In the case of the well site 100 being operated as a production well, the well site 100 may facilitate the extraction of hydrocarbons (or "production") from the reservoir.

The wellbore 130 may include a bored hole that extends from the surface 102 into a target zone of the formation 101, such as the reservoir. An upper end of the wellbore 130, terminating at or near the surface 102, may be referred to as the "up-hole" end of the wellbore 130, and a lower end of the wellbore 130, terminating in the formation, may be referred to as the "down-hole" end of the wellbore 130. The wellbore 130 may facilitate the circulation of drilling fluids during drilling operations, the flow of production (e.g., hydrocarbons such as oil and gas) from the reservoir to the surface 102 during production operations, the injection of substances (e.g., water) into the formation 101 or the reservoir during injection operations, or the communication of monitoring devices (e.g., logging tools) into the formation 101 or the reservoir during monitoring operations (e.g., during in situ logging operations).

In some embodiments, the wellbore 130 may have a cased portion and an uncased (or "open-hole") portion. The cased portion may include a portion of the wellbore having casing (e.g., casing pipe and casing cement) disposed therein. The uncased portion may include a portion of the wellbore not having casing disposed therein. In embodiments having a casing, the casing defines a central passage that provides a conduit for the transport of tools and substances through the wellbore 130. For example, the central passage may provide a conduit for lowering logging tools into the wellbore 130, a conduit for the flow of production (e.g., oil and gas) from the reservoir to the surface 102, or a conduit for the flow of injection substances (e.g., water) from the surface 102 into the formation 101.

In some embodiments, a tubular string, such as a production tubing 131, may be installed in the wellbore 130. The production tubing 131 may provide a conduit for the transport of tools and substances through the wellbore 130. The production tubing 131 may, for example, be disposed inside casing. In such an embodiment, the production tubing 131 may provide a conduit for some or all of the production (e.g., oil and gas) passing through the wellbore 130 and the casing. Additionally, the production tubing 131 includes a tubing-retrievable subsurface safety valve (TRSSSV) 205. The TRSSSV 205 makes up part of the production tubing 131 and is a means for safety close in the case of uncontrolled release of hydrocarbons, such as a kick. Also, the TRSSSV 205 may be used as a barrier when testing or is needed to perform maintenance on the wellhead 130 or downhole.

In some embodiments, a wellhead 103 may include a rigid structure installed at the "up-hole" end of the wellbore 130, at or near where the wellbore 130 terminates at the Earth's surface 102. The wellhead 103 may include structures (called "wellhead casing hanger" for casing and "tubing hanger" for production tubing) for supporting (or "hanging") casing and production tubing extending into the wellbore 130. Production may flow through the wellhead 130, after exiting the wellbore 130, including, for example, the casing and the production tubing 131. Additionally, a blowout preventer (BOP) 200 may be coupled on top of the wellhead 103. The BOP 200 is a valve or stacks of valves device, used to seal, control and monitor oil and gas wells to prevent blowouts, the uncontrolled release of crude oil or natural gas from the wellbore 130. Further, the BOP 200, or a well cap in the case where no BOP provided on the wellhead 103, provides access to wellbore 130 for interventions with a cable such as a wireline, slickline, or coil tubing. In addition, a lubricator 207 may be provided on top of the BOP 200 to lubricate tools being sent into the wellbore 130.

Still referring to FIG. 1, various flow regulating devices are operable to control the flow of substances into and out of the wellbore 130. For example, the wellhead 103 may include a crown valve 201, a wing valve 202, a surface safety valve 203, a master valve 204, and a subsurface safety valve (SSSV) 104. The crown valve 201 is the upper most valve within the wellhead 103. Typically, the crown valve 201 is closed until there is a need to access the wellbore 130. The wing valve 202 is for production flow control. In the case of needing to enter the wellbore 130, the wing valve 202 would be closed and the master valve 204 would be open. The surface safety valve 203 is typically a hydraulic failsafe close valve located at surface. The surface safety valve 203 may be used in the event of an issue in the wellbore/surface equipment and for testing. The master valve (204) is the main valve controlling flow from the wellbore 130. Additionally, the SSSV 206 is another safety device located below the surface 102, e.g., several hundred plus feet below the surface 102. Further, a SSSV test may be conducted to confirm the SSSV 206 is operational. For example, the SSSV test a fitting is connected on a control line which connects to a hand pump. Next, a wellhead pressure is checked and then the wellhead pressure is bled 50%. With the wellhead pressure bleed, a user waits for 10 minutes and if there is no buildup of the pressure, then the user will operate the hand pump to pump through the control line to open the SSSV 206.

Figure 2A:
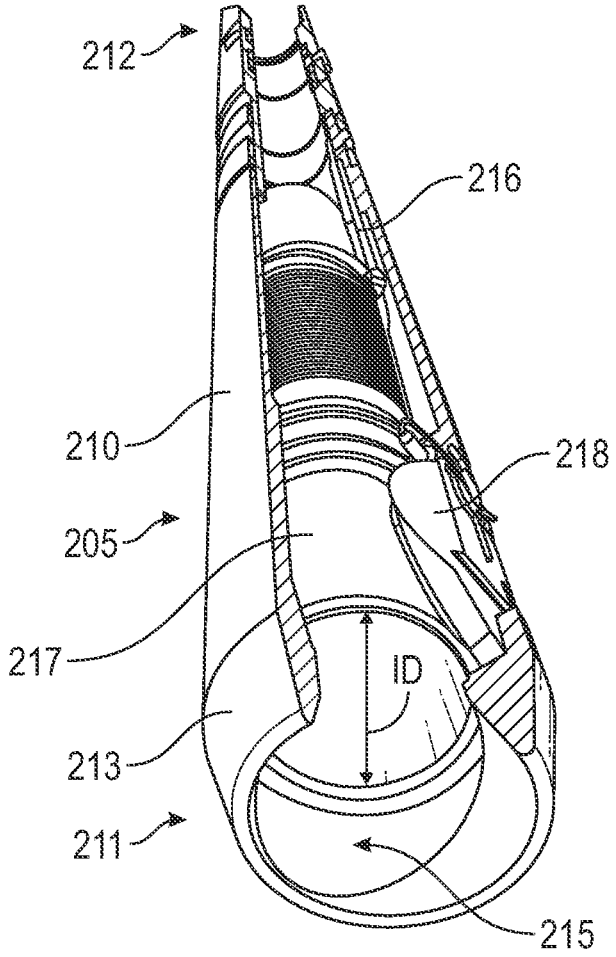
FIGS. 2A and 2B illustrate a cross-sectional view of a tubing-retrievable subsurface safety valve in accordance with one or more embodiments.
Figure 2B:
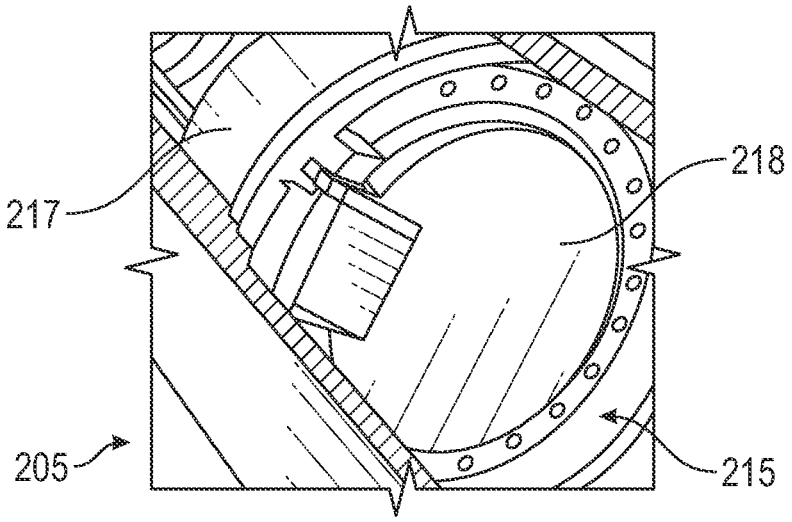

Now referring to FIGS. 2A and 2B, a cross-section view of the TRSSSV 205 is illustrated. The TRSSSV 205 is shown in an open position in FIG. 2A and in a closed position in FIG. 2B. The TRSSSV 205 includes a body 210 axially extending from a first end 211 to a second end 212. The body 210 defines a bore 215 that provides a conduit for downhole tools and for fluids to pass through. The first end 211 may be a lower end which is positioned downward in the wellbore. Additionally, the first end 211 may include a sloped surface 213 to land on the ported nipple sub. The second end 212 may be an upper end which is positioned upward in the wellbore. Further, the second end 212 may be fish neck of the TRSSSV 205.

In one or more embodiments, as shown in FIG. 2A, the TRSSSV 205 includes various internal components to conduct operations. For example, a hydraulic pressure system provides power to the TRSSSV 205 to axially move an actuation device 217 to open and close a flapper 218. For example, a hydraulic line 216 applies hydraulic pressure and moves the actuation device 217, such as a piston, downward to push the flapper 218 into the open position, as shown in FIG. 2A. Additionally, an inner diameter ID of the actuation device 217 may be equal to a nominal inner diameter of the TRSSSV 205 which limits the size of downhole tools able to pass through the TRSSSV 205. With the flapper 218 in the open position, access to the wellbore is allowed to conduct various downhole operations such as well intervention.

As shown in FIG. 2B, if the TRSSSV 205 fails, the actuation device 217 will move axially upward and allow the flapper 218 to move the closed position. In the closed position, the flapper 218 closes the bore 215 thereby blocking access to the wellbore. In the closed position, the TRSSSV 205 prevents downhole operations from being conducted which may increase NPT, damage equipment, make the work environment hazardous, or cause a total well loss. In some embodiments, if the flapper 218 closes during a well intervention operation, the downhole tools, such as a bottomhole assembly (BHA), cannot be pulled out-of-hole (POH) and the wireline, slickline, or coiled tubing must be cut resulting in loss of equipment (e.g., the downhole tools) downhole or having to conduct fishing operations. Alternatively, if the flapper 218 closes before a well intervention operation, the downhole tools, such as a bottomhole assembly (BHA), cannot be run-in-hole (RIH).

In the case that the TRSSSV 205 fails, to prevent the flapper 218 from being in the closed position blocking downhole operations, a flapper holder tool, as described below, is deployed to force open the flapper 218 of the TRSSSV 205 to allow operations to continue.

Figure 3:
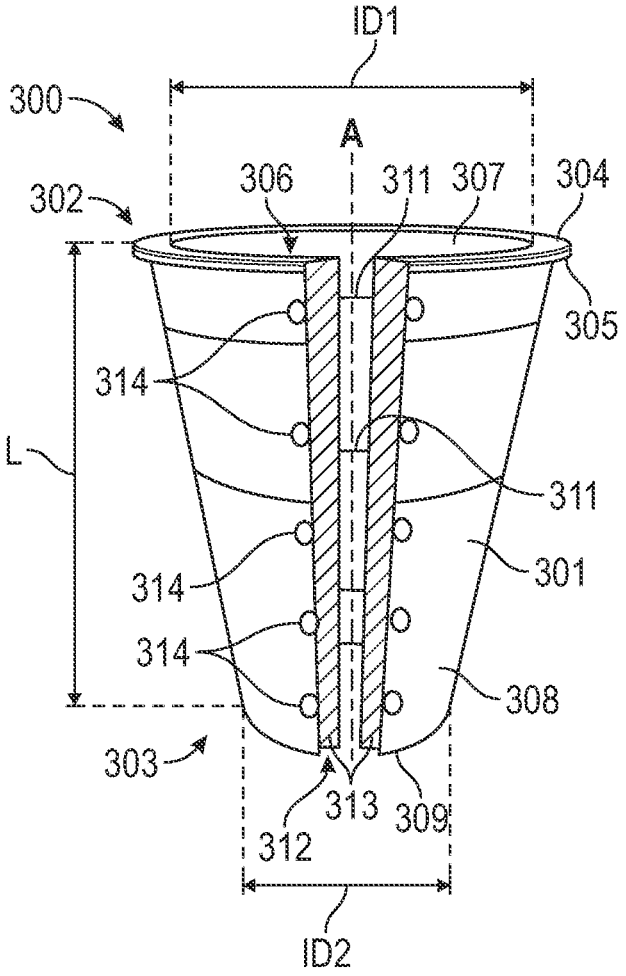
FIG. 3 illustrates a perspective view of a flapper holder tool in accordance with one or more embodiments.

Referring to FIG. 3, in one or more embodiments, a flapper holder tool 300 is illustrated. The flapper holder tool 300 includes a tubular body 301 formed from a body radially extending from an inner surface 307 to an outer surface 308 to define a bore 306. Additionally, the tubular body 301 extends axially a length L from a first end 302 to a second end 303. Further, the bore 306 extends the length L axially along an axis A. It is further envisioned that the bore 306 may have tapered diameter such that the outer surface 308 is a tapered outer surface and the inner surface 307 is tapered inner surface. For example, an inner diameter ID1 at the first end 302 may be larger than an inner diameter ID2 at the second end 303 such that the tubular body 301 progressively gets smaller from the first end 302 to the second end 303. The inner diameter ID1 may have a maximum valve equal to the inner diameter (ID) of the actuation device (217) of the TRSSSV (205) and the inner diameter ID2 may have a minimum valve equal to largest outer diameter of a downhole tool that may pass through the TRSSSV (205).

At the first end 302, a lip 304 extends radially outwardly from the tubular body 301 to land within the TRSSSV (205). For example, when deployed, the lip 304 lands atop of the TRSSSV (205). Additionally, as the lip 304 extends radially outward from the tubular body 301, the lip 304 also acts as a no-go device to prevent the flapper holder tool 300 from failing through the TRSSSV (205). For example, the lip 304 sits on top of or within the TRSSSV (205). It is further envisioned that a seal 305, such as an elastomer seal or O-ring, may be provided in the lip or groove 304 to provides a seal between the flapper holder tool 300 and the TRSSSV (205).

At the second end 303, the tubular body 301 may include an engagement surface 309 to contact the flapper (218) of the TRSSSV (205). For example, when deployed, the engagement surface 309 lands on the flapper (218) and a downward force of the flapper holder tool forces the flapper (218) open. Additionally, the engagement surface 309 may include a rubber material or coating to prevent damage to and from the flapper (218). It is further envisioned that the tubular body 301 is a rigid member made of a metal, such as steel, or a resilient material (i.e., a stem or weight bar) that can provide and within stand a force to push open the flapper (218) of the TRSSSV (205).

In some embodiments, as the flapper (218) is being opened by the flapper holder tool 300, the flapper (218) may scrap against the outer surface 308. The outer surface 308 may include a coating to reduce a friction between the flapper (218) and the outer surface 308. By reducing the friction, the flapper holder tool 300 can continue moving downward, move the flapper (218) to a fully opened position, and avoid become stuck to high up in the TRSSSV (205) from the scrapping against the outer surface 308.

In one or more embodiments, the flapper holder tool 300 may include an internal fish neck 311. For example, the internal fish neck 311 may be one or more grooves or notches on the inner surface 307 to allow a downhole tool to engage the internal fish neck 311. With the downhole tool engaged to the internal fish neck 311, both the downhole tool and the flapper holder tool 300 may be retrieved to the surface.

Still referring to FIG. 3, in one or more embodiments, the tubular body 301 may include an opening 312 to receive a cable. For example, one or more ledges 313 may extend into the opening 312 to form a seat for the cable. Additionally, a plurality of set screws 314 may be used to close the opening 312 around the cable and lock the flapper holder tool 300 to the cable.

Figure 4:
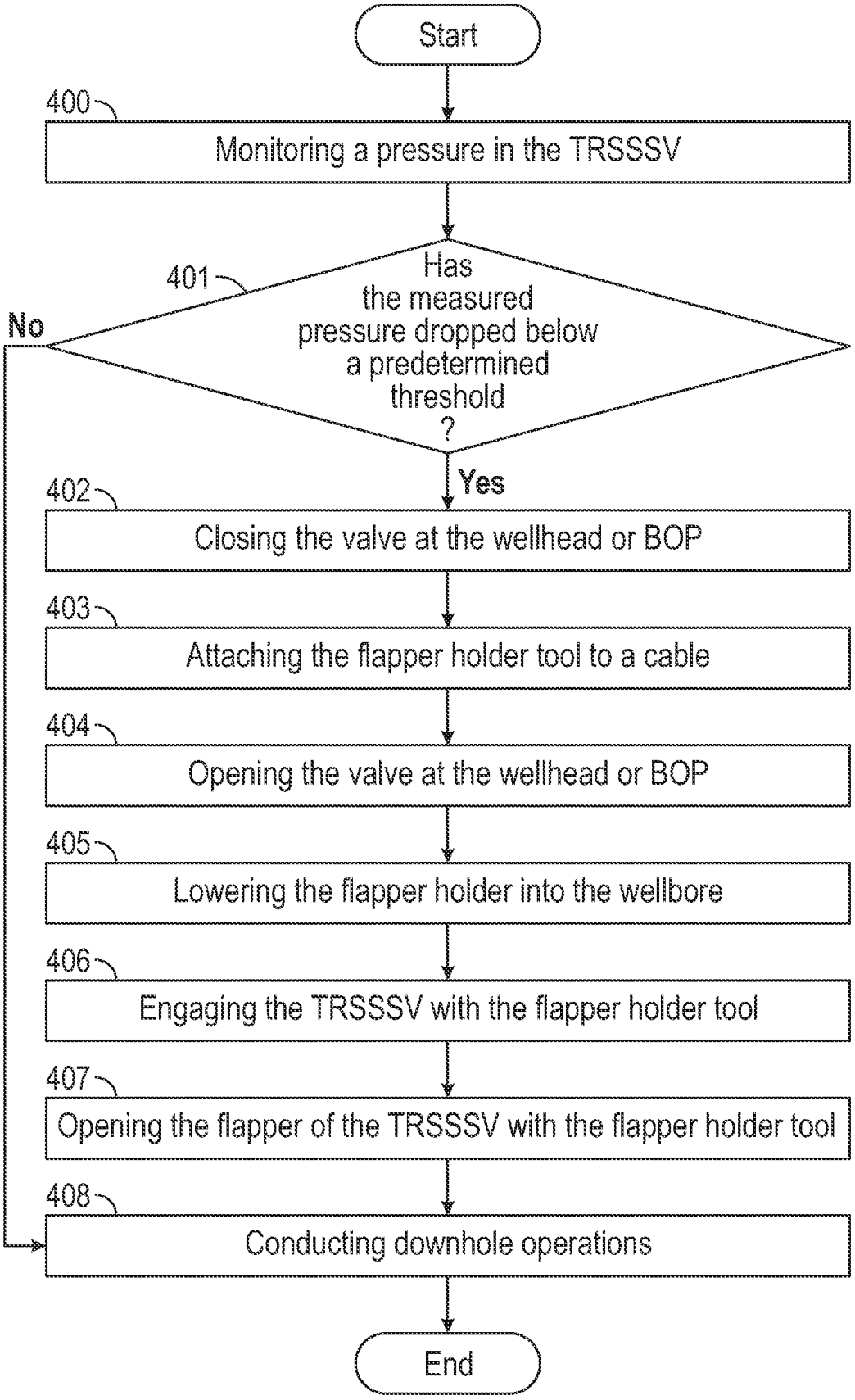
FIG. 4 illustrates a flowchart in accordance with one or more embodiments.

FIG. 4 is a flowchart showing a method of using the flapper holder tool 300 of FIG. 3 at a well site (such as the well site described in FIG. 1) when a cable (e.g., wireline, slickline, or coiled tubing) is deployed into the wellbore and passed the TRSSSV. One or more blocks in FIG. 4 may be performed by one or more components (e.g., a computing system coupled to a controller in communication with the devices at the well site 100). For example, a non-transitory computer readable medium may store instructions on a memory coupled to a processor such that the instructions include functionality for deploying the flapper holder tool 300. While the various blocks in FIG. 4 are presented and described sequentially, one of ordinary skill in the art will appreciate that some or all of the blocks may be executed in different orders, may be combined or omitted; and some or all of the blocks may be executed in parallel. Furthermore, the blocks may be performed actively or passively.

In Block 400, a pressure to the TRSSSV is continuously monitored. For example, various pressure sensors positioned in the wellbore and on the surface may measure an amount of pressure being provided to the TRSSSV. The various pressure sensors transmit the measurements to a controller and/or operator to be monitored.

In Block 401, the measured pressure is compared to predetermined thresholds. For example, the predetermined threshold of the pressure to the TRSSSV may be a value equal to a minimum amount of pressure (for example, a required hydraulic pressure of 4,000-10,000 psi) required to keep the TRSSSV open (i.e., the actuation device is moved to a downward position to displace the flapper to the open position). If the measured pressure has not dropped below the predetermined threshold, this indicates that the TRSSSV is maintained in the open position, thereby allowing downhole operations to be conducted as shown in Block 408.

However, if the measured pressure has dropped below the predetermined threshold, this indicates that the TRSSSV has failed (i.e., the actuation device has moved upward no longer engaging the flapper, and the flapper is moved to the closed position). With the TRSSSV indicated as failed, the method moves to Block 402.

In addition to or as an alternative to Blocks 401 and 402, to determine if the TRSSSV indicated has failed, a cable traveling through the TRSSSV may be pulled on to see if the cable can be moved upward or downward. If the cable can be moved upward, then the TRSSSV has not failed as the gate valve must be opened for the cable to move upward. However, if the cable cannot be moved upwards nor downwards, this indicates that the TRSSSV has failed, and the method moves to the Block 402.

In Block 402, with the TRSSSV indicated as failed, a valve at the wellhead or BOP is closed. If there is no BOP on top of the wellhead, the main valve of the wellhead is closed. If there is a BOP stacked on top of the wellhead, the valve of the BOP is closed. By closing the valve in the wellhead or the BOP, the wellbore is shutoff and allows surface operations to be conducted safely.

In Block 403, with the valve in the wellhead or the BOP closed, the flapper holder tool is attached to a cable, such as a wireline, slickline, or coiled tubing, and run into the wellbore. For example, the flapper holder tool is placed over an end of the cable outside the wellhead or the BOP such that the cable runs through the flapper holder tool. Additionally, the cable is set within the opening of the flapper holder tool and set screws lock the cable with the flapper holder tool.

In Block 404, with the flapper holder tool on the cable/wireline/tubing, the valve at the wellhead or BOP is opened to allow the flapper holder tool to travel into the wellbore. In the case of having a BOP at the well site, pressure is equalized between the BOP and lubricator before the BOP is opened In Block 405, with the valve in the wellhead or the BOP opened, the flapper holder tool is lowered into the wellbore. For example, the flapper holder tool travels along a length of the cable to reach a predetermined depth in the wellbore. The predetermined depth is a depth at which the TRSSSV is disposed within the wellbore.

In Block 406, the flapper holder tool engages with the TRSSSV. For example, the lip of the flapper holder tool lands on top or within the TRSSSV. In some embodiments, the lip sits above the flapper of the TRSSSV. The lip may seal against a surface of the TRSSSV such as an upper most end of the TRSSSV.

In Block 407, with the flapper holder tool landed on the TRSSSV, the flapper of the TRSSSV is opened by the flapper holder tool via the downward force from dropping the flapper holder tool. For example, an end of the tubular body of the flapper holder tool contacts the flapper and applies a downward force on the flapper to move the flapper to the open position. Additionally, as the flapper scraps against the tubular body, a coating on an outer surface of the tubular body reduces a friction between the flapper and the tubular body. Additionally, to determine if the flapper has been opened by the flapper holder tool, the cable traveling through the TRSSSV is pulled upward; and if the cable is not restricted by the flapper, the cable is able to move upward.

In Block 408, with the flapper forcibly opened by the flapper holder tool, downhole operations are conducted. For example, well intervention operations such as retrieval of trapped downhole tools are conducted (i.e., rescuing downhole tools by pulling up along with the flapper holder tool). Specifically, the trapped downhole tools may be pulled upward, along the flapper holder tool, and out of the wellbore for maintenance, repair, or replacement. Additionally, a running tool may be RIH to engage the fish neck of the flapper holder tool for retrieval.

Now referring FIGS. 5-9, in one or more embodiments, FIGS. 5-9 illustrate a system of implementing the method described in the flowchart of FIG. 4 using the flapper holder tool 300 of FIG. 3 in a well intervention operation.

Figure 5:
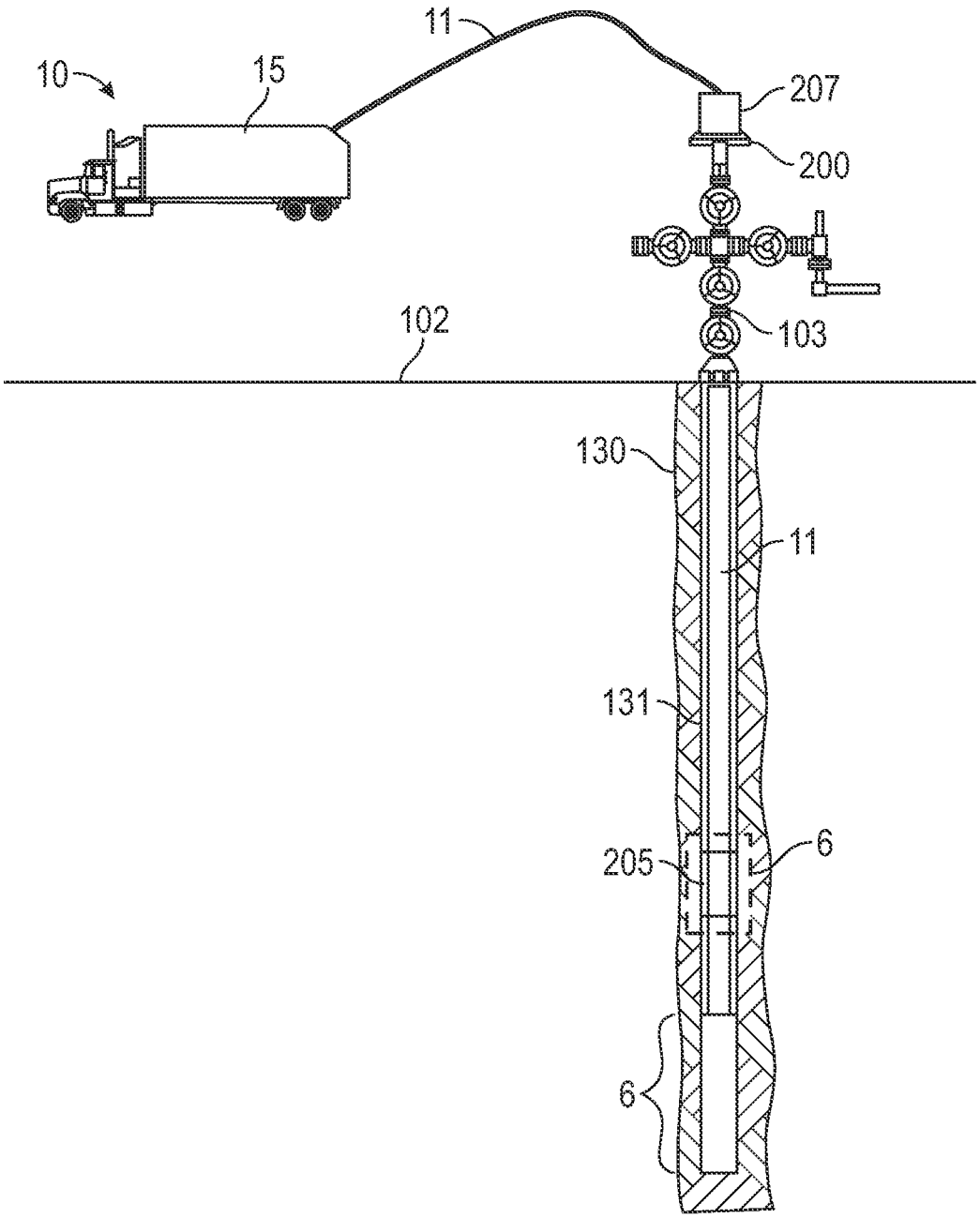
FIGS. 5-9 show examples of implementing the method of FIG. 4 using the flapper holder tool of FIG. 3 in accordance with one or more embodiments of the present disclosure.

In FIG. 5, in one or more embodiments, a close-up view of the surface 102 of FIG. 1 is illustrated. In a well intervention operation, a cable 11 is employed from a cable unit 10 into the wellhead 103. The cable unit 10 may be a truck 15 or trailer having a drum to spool and unspool the wireline, slickline, or coiled tubing. The cable 11 may be inserted into the wellhead 103 via the lubricator 207 and through the BOP 200 rigged on top of the wellhead 103. The BOP 200 may include a blind ram to close and seal around the cable 11 which allows operations to be performed under pressure, on surface equipment, when the cable 11 is still in the wellbore 103. Then the valves of the wellhead 103 are opened to enable the cable 11 to fall or be pumped into the wellbore 130 under pressure.

From the wellhead 103, the cable 11 passes through the TRSSSV 205, down a tubular string, such as the production tubing 131, and connects down to a bottomhole assembly (BHA) 6. The BHA 6 may include various components such as drill bits, drill collars, mud motors, stabilizers, sensitive measurement equipment, logging while drilling (LWD) tools, measurement while drilling (MWD) tools, and various other downhole tools without departing from the scope of the present disclosure.

Figure 6:
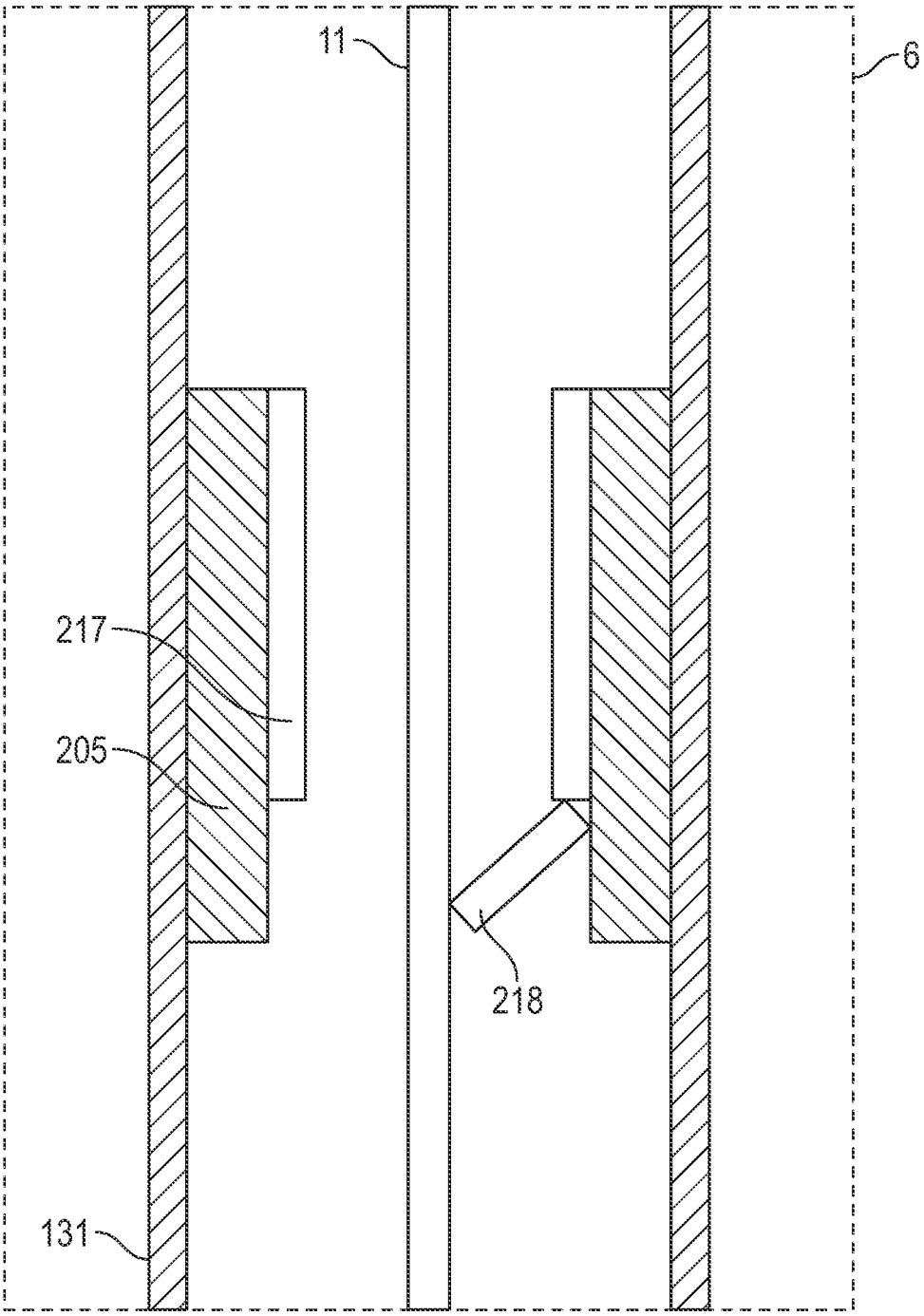

FIG. 6 illustrates a closeup cross-sectional view of the dotted box 6 of FIG. 5. As previously described, the TRSSSV 205 makes up a part of the production tubing 131. In the case that the pressure system fails, the pressure within the TRSSSV 205 has dropped allowing the actuation device 217 to move axially upward and to move the flapper 218 out of the open position. Without the flapper 218 in the open position, the flapper 218 encounters the wire 11.

Figure 7:
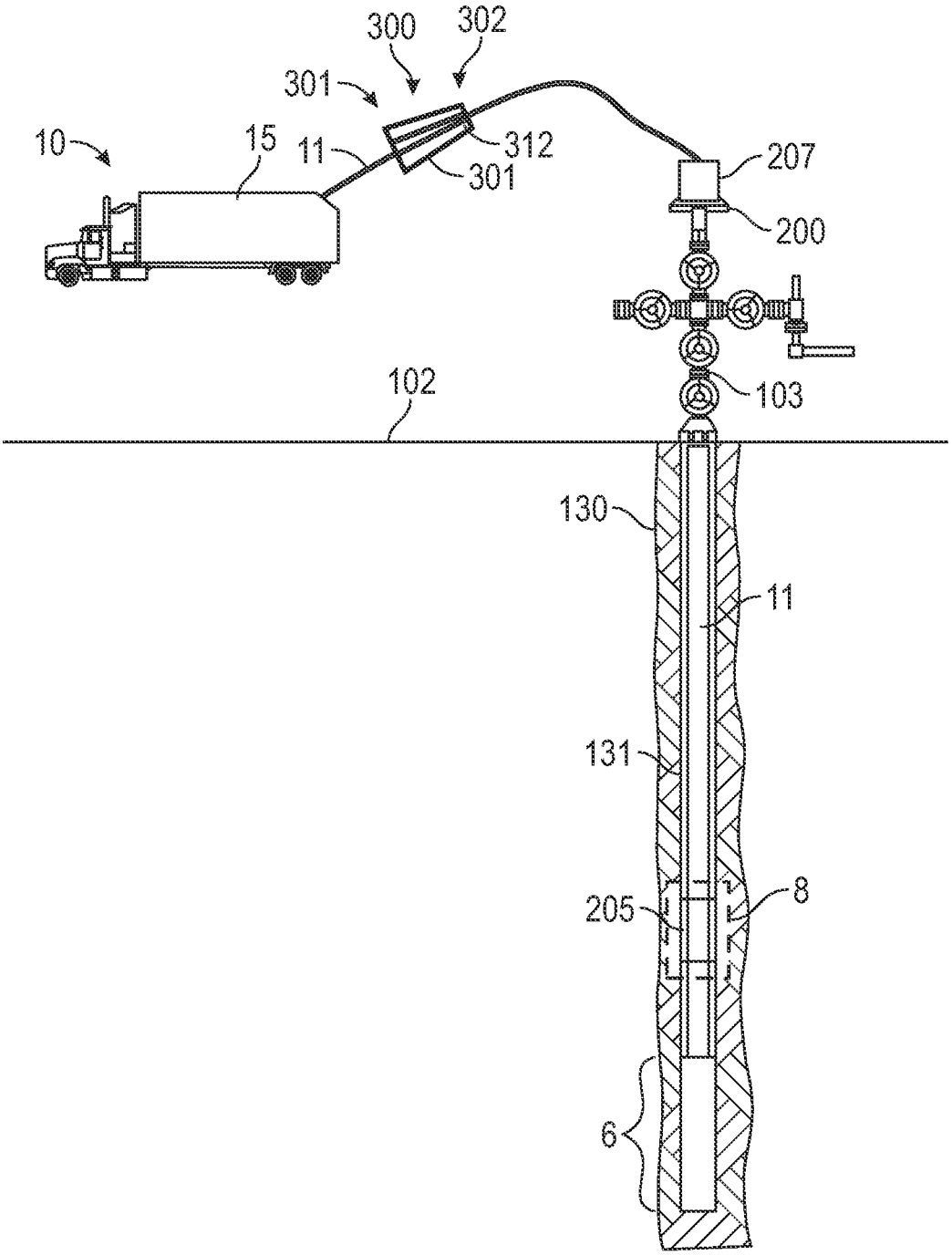

Now referring to FIG. 7, as the TRSSSV 205 has failed, the flapper holder tool 300 (as described in FIG. 3) is deployed to move the flapper (218) back to the open position. The flapper holder tool 300 is attached to the cable 11 on the surface 102. For example, the cable 11 is run through the second end 303 so that the cable 11 travels through the bore (306) of the tubular body 301, and past the first end 302 to exit the flapper holder tool 300. Additionally, the cable 11 is set on the one or more ledges (313) of the flapper holder tool 300 within the opening 312 (314) that is defined in the bore (309). Further, the plurality of set screws (314) locks the cable 11 to the flapper holder tool 300.

With the flapper holder tool 300 on the cable 11, pressure between the BOP 200 and the lubricator is equalized. After equalizing that the pressure, the BOP 200 is opened to allow the flapper holder tool 300 to be lowered in the wellbore 130 and land TRSSSV 205. For example, the flapper holder tool 300 may be simply dropped down the wellbore 130 to generate a force downward on the TRSSSV 205.

Figure 8:
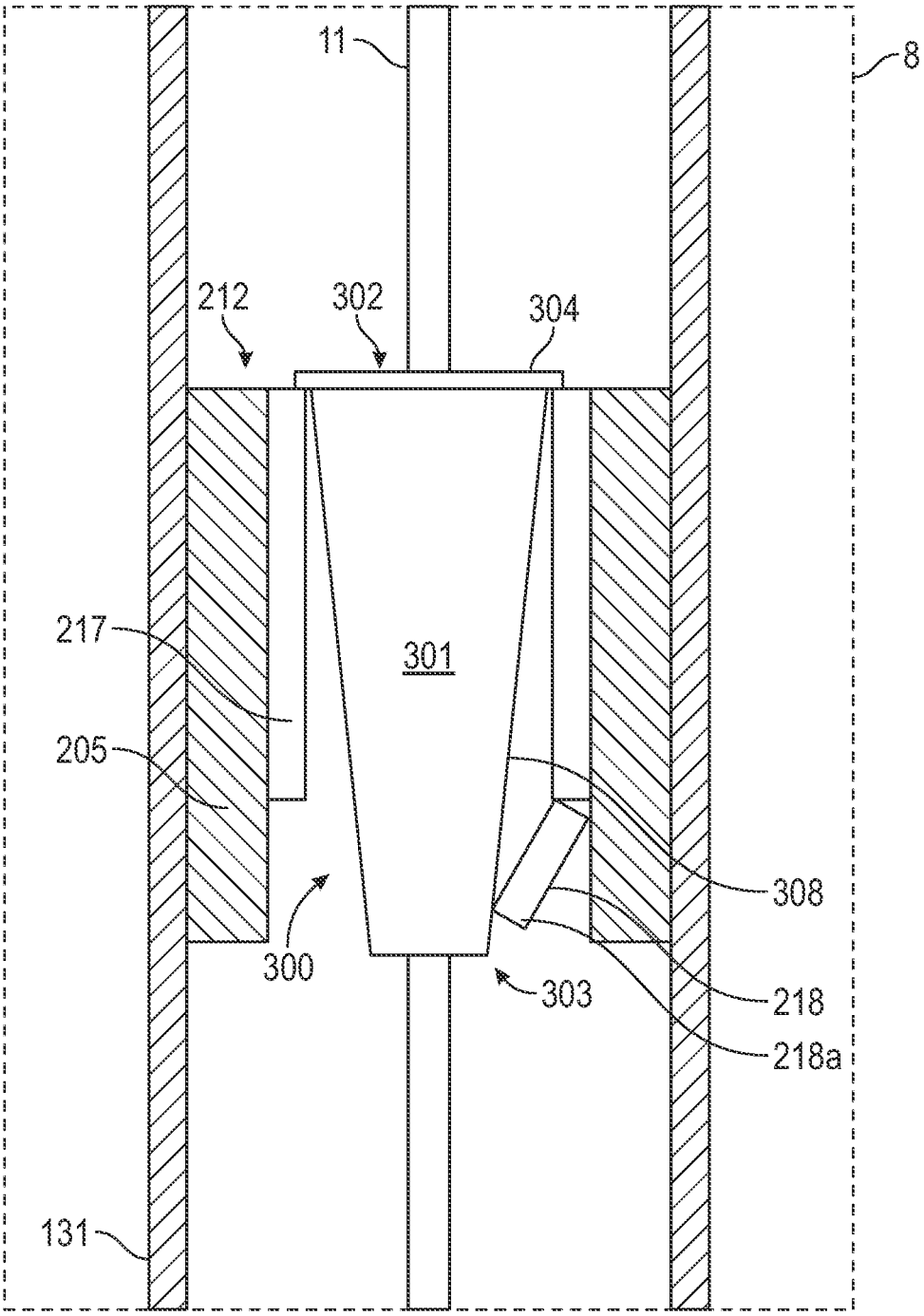

FIG. 8 illustrates a closeup cross-sectional view of the dotted box 8 of FIG. 7. As previously described, the flapper holder tool 300 is deployed and lowered down the production tubing 131. The lip 304 at the first end 302 lands on the TRSSSV 205. For example, the lip 304 sits on the second end 212 (i.e., an upper most end) of the TRSSSV 205. From the first end 302, the tubular body 301 extends downward such that the second end 303 forces that the flapper 218 to the open position. Additionally, the flapper 218 is contacting the outer surface 308 of the tubular body 301. In some embodiments, a coating on the outer surface 308 reduces a friction between the flapper 218 and the tubular body 301. With the flapper 218 back in the open position, well intervention operations may continue.

Figure 9:
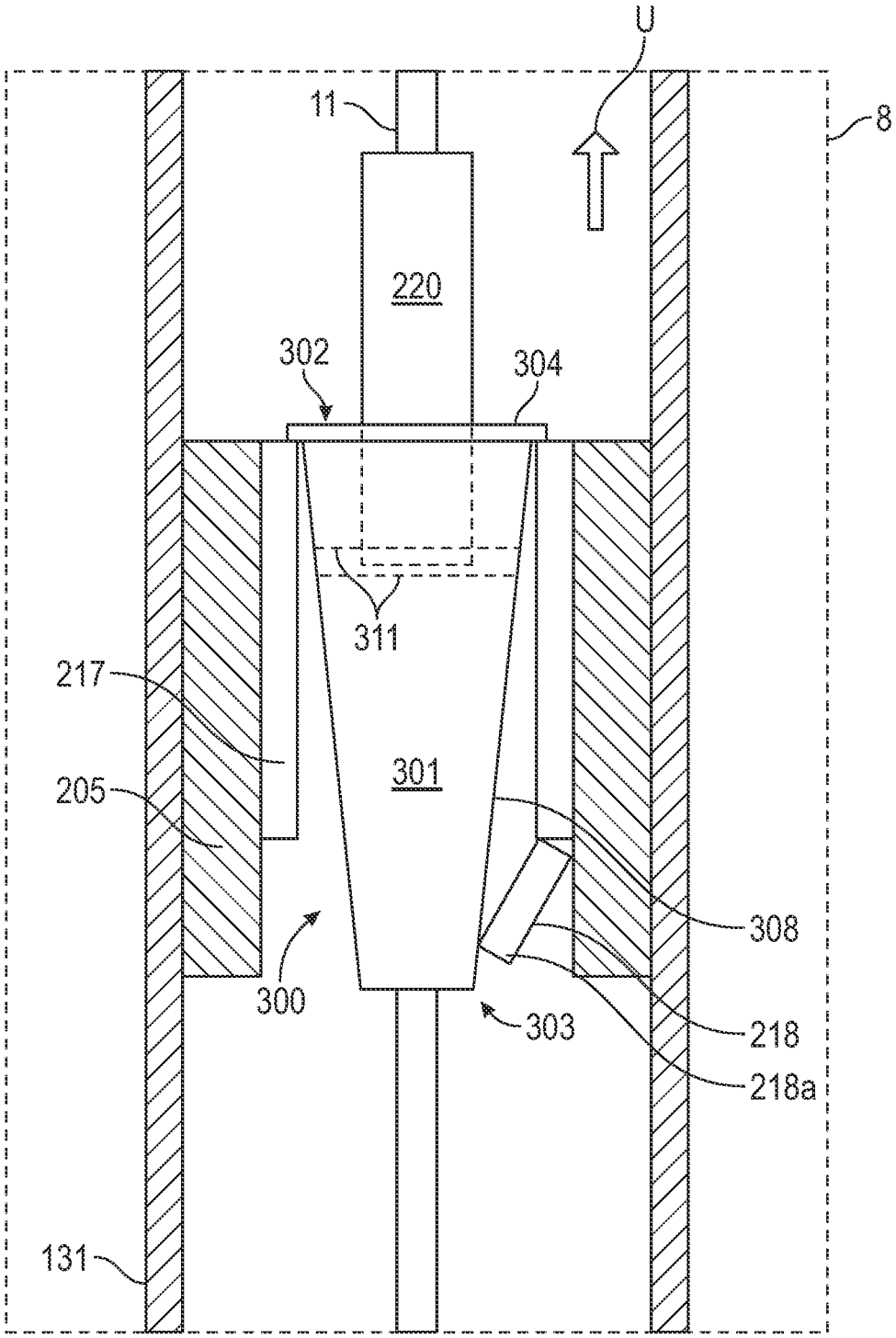

Now referring to FIG. 9, with the flapper holder tool 300 landed on the TRSSSV 205 and moving the flapper 218 to the open position, a running/pulling tool 220 may be sent into the wellbore 130 to retrieve the flapper holder tool 300 and/or the BHA 6. The running/pulling tool 220 may be lowered into the first end 302 to engage the internal fish neck 311. Once engaged with the internal fish neck 311, the running/pulling tool 220 may be move upward (see block Arrow U) via the cable 11 to retrieve the flapper holder tool 300 and/or the BHA 6. As the BHA 6 travels upward, the BHA 6 will engage the flapper holder tool 300. The BHA 6 and the flapper holder tool 300 may be raised together to the surface (108) for maintenance, repairs, or replacement.

Figure 10:
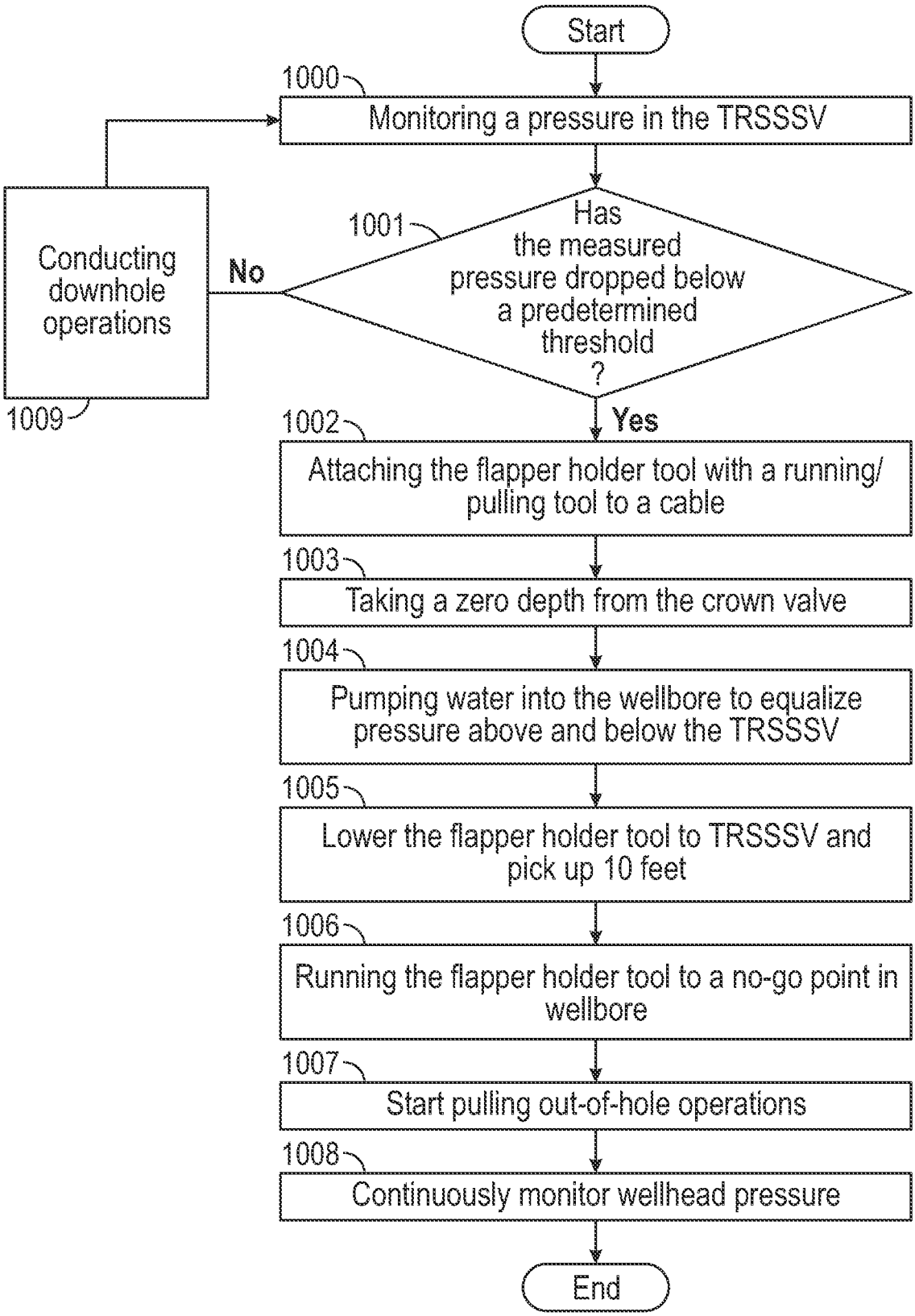
FIG. 10 illustrates a flowchart in accordance with one or more embodiments.

FIG. 10 is a flowchart showing another method of using the flapper holder tool 300 of FIG. 3 at a well site (such as the well site described in FIG. 1) when the cable (e.g., wireline, slickline, or coiled tubing) has not yet passed through the TRSSSV. One or more blocks in FIG. 10 may be performed by one or more components (e.g., a computing system coupled to a controller in communication with the devices at the well site 100). For example, a non-transitory computer readable medium may store instructions on a memory coupled to a processor such that the instructions include functionality for deploying the flapper holder tool 300. While the various blocks in FIG. 10 are presented and described sequentially, one of ordinary skill in the art will appreciate that some or all of the blocks may be executed in different orders, may be combined or omitted; and some or all of the blocks may be executed in parallel. Furthermore, the blocks may be performed actively or passively.

In Block 1000, a pressure to the TRSSSV is continuously monitored. For example, various pressure sensors positioned in the wellbore and on the surface may measure an amount of pressure being provided to the TRSSSV. The various pressure sensors transmit the measurements to a controller and/or operator to be monitored.

In Block 1001, the measured pressure is compared to predetermined thresholds. For example, the predetermined threshold of the pressure to the TRSSSV may be a value equal to a minimum amount of pressure (for example, a required hydraulic pressure of 4,000-10,000 psi) required to keep the TRSSSV open (i.e., the actuation device is moved to a downward position to displace the flapper to the open position). If the measured pressure has not dropped below the predetermined threshold, this indicates that the TRSSSV is maintained in the open position, thereby allowing downhole operations to be conducted as shown in Block 1009. However, if the measured pressure has dropped below the predetermined threshold, this indicates that the TRSSSV has failed (i.e., the actuation device has moved upward no longer engaging the flapper, and the flapper is moved to the closed position). With the TRSSSV indicated as failed, the method moves to the Block 1002.

In Block 1002, with the TRSSSV indicated as failed, the flapper holder tool with a running/pulling tool is attached to a cable, such as a wireline, slickline, or coiled tubing, and run into the wellbore. For example, the flapper holder tool is placed over an end of the cable outside the wellhead or the BOP such that the cable runs through the flapper holder tool. Additionally, the cable is set within the opening of the flapper holder tool and set screws lock the cable with the flapper holder tool. Furthermore, the running/pulling tool is engaged with internal fish neck of the flapper holder tool.

In Block 1003, a zero depth is taken from the crown valve of the wellhead. For example, a depth of the flapper holder tool in the well is taken from the crown valve as the datum.

In Block 1004, water is pumped into the wellbore to equalize a pressure above and below the TRSSSV. For example, fresh water may be pumped through the wing valve of the wellhead and into the wellbore and flow through the TRSSSV via the production tubing.

In Block 1005, the flapper holder tool is lowered into the wellbore (i.e., RIH) to a depth of the TRSSV and then picked up 10 feet. By picking up 10 feet above the TRSSV, weight is picked up from the running tool and a weight of the tool string is measured. Additionally, the flapper holder tool engages with the TRSSSV. For example, the lip of the flapper holder tool lands within the TRSSSV. In some embodiments, the lip sits above the flapper of the TRSSSV. The lip may seal against a surface in the TRSSSV.

In Block 1006, the flapper holder tool is run further downhole to a no-go point. The no-go point is when the lip of the flapper holder tool lands on the TRSSSV. Additionally, at the no-go point, the flapper holder tool is jarred down to shear the running/pulling tool.

In Block 1007, pulling out-of-hole operations are started. As the cable is pulled upward, a weight being pulled is measured. The measured weight is compared to the weight of the tool string without the flapper holder tool to ensure that the flapper holder tool has been set on the TRSSSV.

In Block 1008, the wellhead pressure is continuously monitored. For example, a pressure gauge at the wellhead may provide continuously readings to confirm the TRSSSV is opened. With the flapper holder tool opening the TRSSSV, the pressure gauge will record an increase in pressure to provide the pressure within the well is back to the pressure with the TRSSSV open.

Now referring to FIGS. 11-17, in one or more embodiments, FIGS. 11-17 illustrate a system of implementing the method described in the flowchart of FIG. 10 using the flapper holder tool 300 of FIG. 3 in a well intervention operation.

Figure 11:
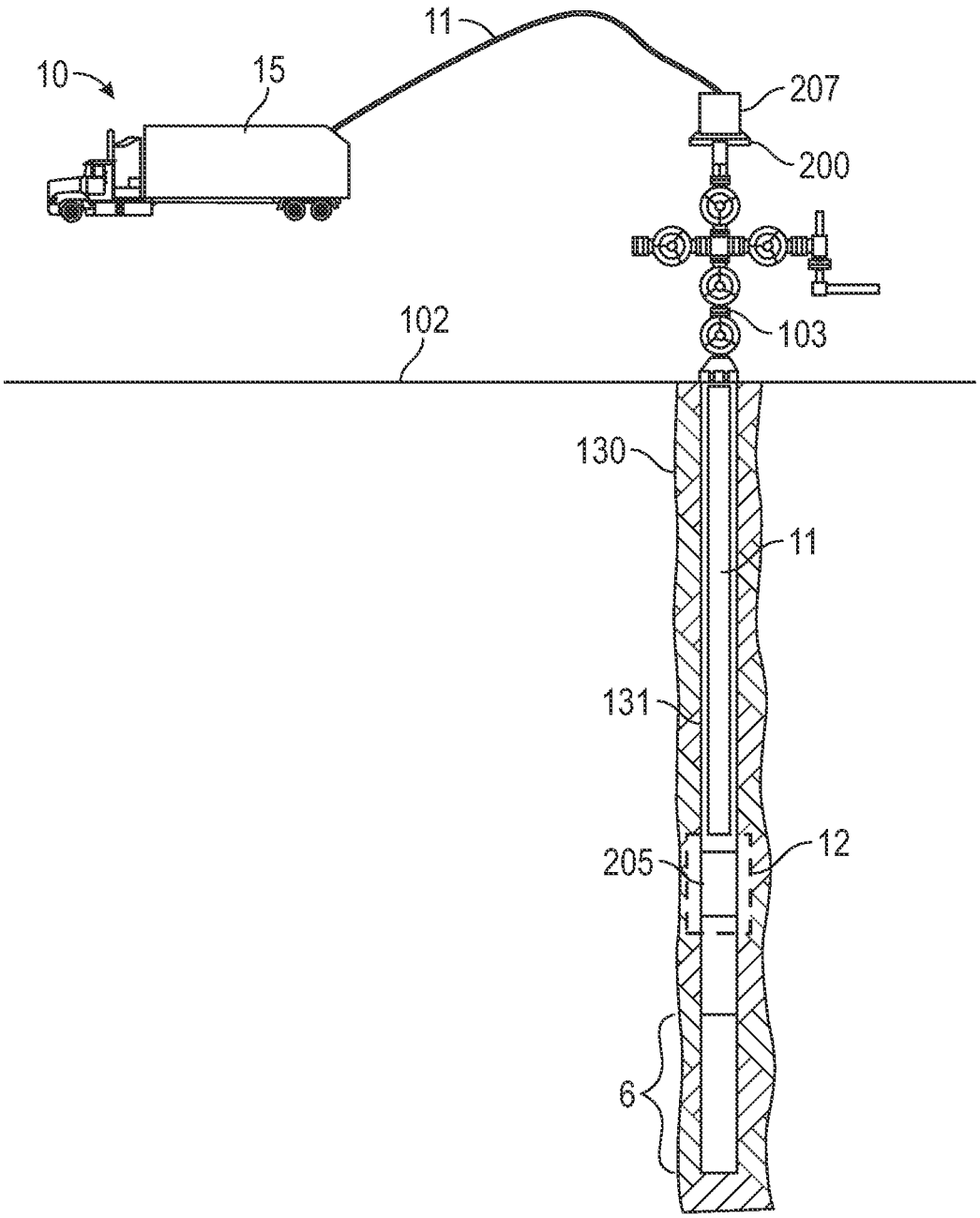
FIGS. 11-17 show examples of implementing the method of FIG. 10 using the flapper holder tool of FIG. 3 in accordance with one or more embodiments of the present disclosure.

In FIG. 11, in one or more embodiments, a close-up view of the surface 102 of FIG. 1 is illustrated. In a well intervention operation, a cable 11 is employed from a cable unit 10 into the wellhead 103. The cable unit 10 may be a truck 15 or trailer having a drum to spool and unspool the wireline, slickline, or coiled tubing. The cable 11 may be inserted into the wellhead 103 via the lubricator 207 and through the BOP 200 rigged on top of the wellhead 103. The BOP 200 may include a blind ram to close and seal around the cable 11 which allows operations to be performed under pressure, on surface equipment, when the cable 11 is still in the wellbore 103. Then the valves of the wellhead 103 are opened to enable the cable 11 to fall or be pumped into the wellbore 130 under pressure.

From the wellhead 103, the cable 11 down a tubular string, such as the production tubing 131, and has not passed through the TRSSSV 205 yet. At an end of the production tubing 131 below the TRSSSV 205 may be a bottomhole assembly (BHA) 6. the BHA 6 may include various components such as drill bits, drill collars, mud motors, stabilizers, sensitive measurement equipment, logging while drilling (LWD) tools, measurement while drilling (MWD) tools, and various other downhole tools without departing from the scope of the present disclosure.

Figure 12:
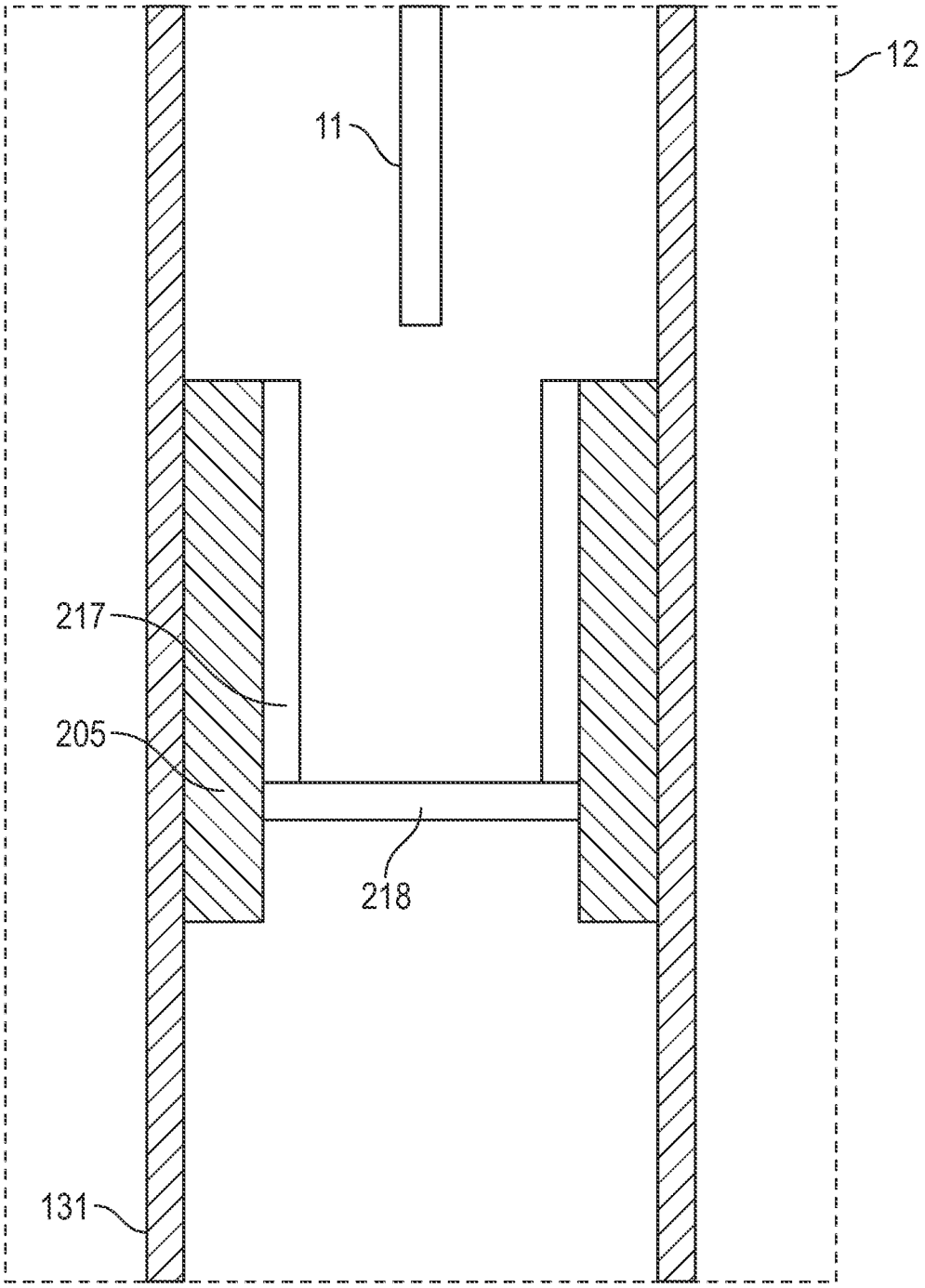

FIG. 12 illustrates a closeup cross-sectional view of the dotted box 12 of FIG. 11. As previously described, the TRSSSV 205 makes up a part of the production tubing 131. In the case that the pressure system fails, the pressure within the TRSSSV 205 has dropped allowing the actuation device 217 to move axially upward and to move the flapper 218 out of the open position. Without the flapper 218 in the open position, the flapper 218 closes a bore the production tubing 131 thereby not allowing the cable 11 to pass through the TRSSSV 205.

Figure 13:
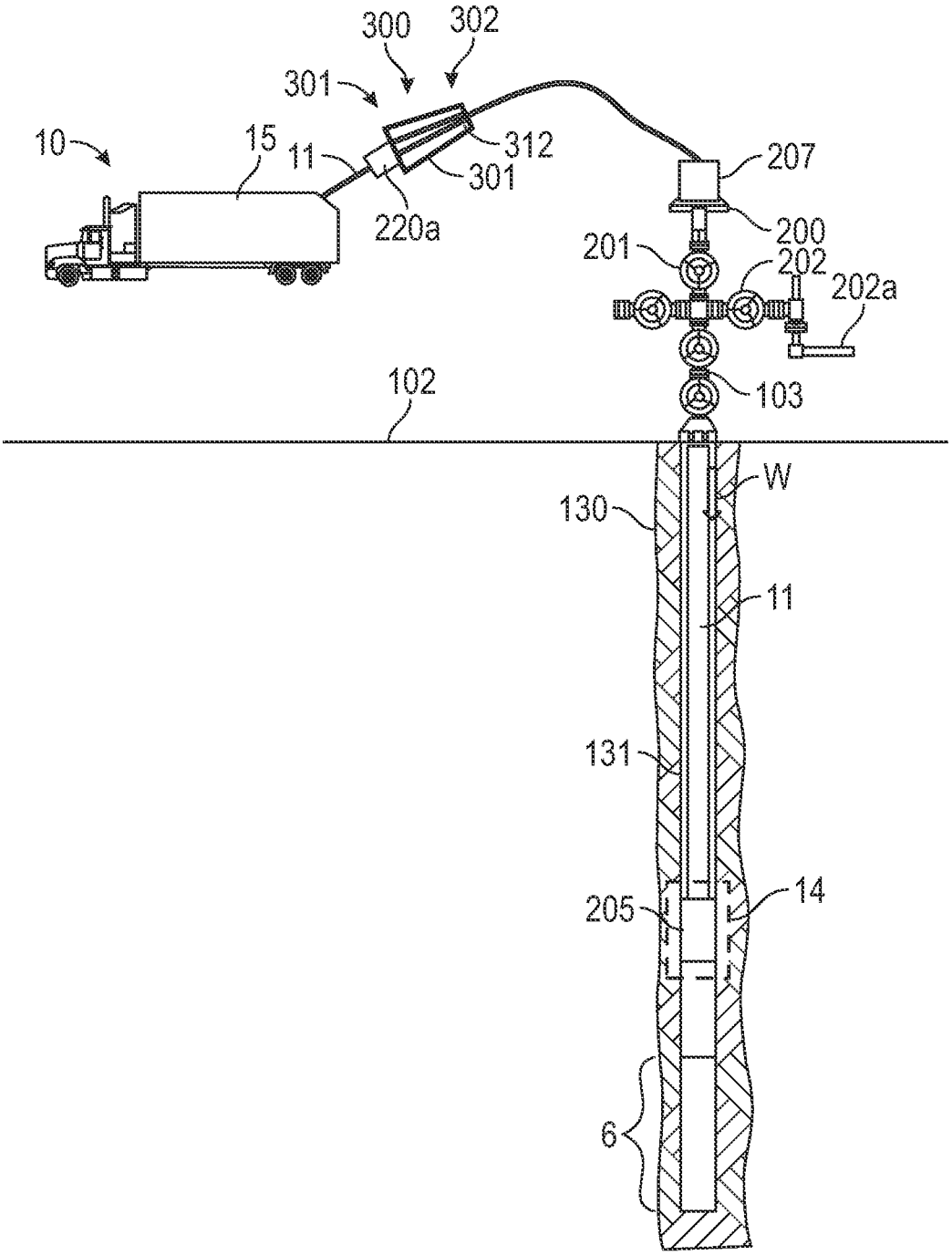

Now referring to FIG. 13, as the TRSSSV 205 has failed, the flapper holder tool 300 (as described in FIG. 3) is deployed to move the flapper (218) back to the open position. The flapper holder tool 300 is attached to the cable 11 on the surface 102 with a running tool 220*a*. For example, the cable 11 is run through the second end 303 so that the cable 11 travels through the bore (306) of the tubular body 301, and past the first end 302 to exit the flapper holder tool 300. Additionally, the cable 11 is set on the one or more ledges (313) of the flapper holder tool 300 within the opening 312 (314) that is defined in the bore (309). Further, the plurality of set screws (314) locks the cable 11 to the flapper holder tool 300.

With the flapper holder tool 300 on the cable 11, a zero depth measurement is taken from the crown valve 201 of the wellhead 103 to establish a datum for depth measurements with respect to the flapper holder tool 300 Additionally, a fluid line 202*a* may be attached to the wing valve 202 of the wellhead 103. Through the fluid line 202*a*, a fluid is pumped (see arrow W) into the wellbore 130 to equalize a pressure above and below the TRSSSV 205. For example, the fluid may be fresh water pumped through the wing valve 202 and into the wellbore 130 and flow through the TRSSSV 205 via the production tubing 131. Once the pressure is equalized above and below the TRSSSV 205, the fluid is no longer pumped into the wellbore 130.

In one or more embodiments, pressure between the BOP 200 and the lubricator is equalized. After equalizing the pressure, the BOP 200 is opened to allow the flapper holder tool 300 to be lowered in the wellbore 130 and land TRSSSV 205. For example, the cable 11 is further lowered to be adjacent or contact the TRSSSV 205 and the flapper holder tool 300 is simply dropped down the wellbore 130.

Figure 14:
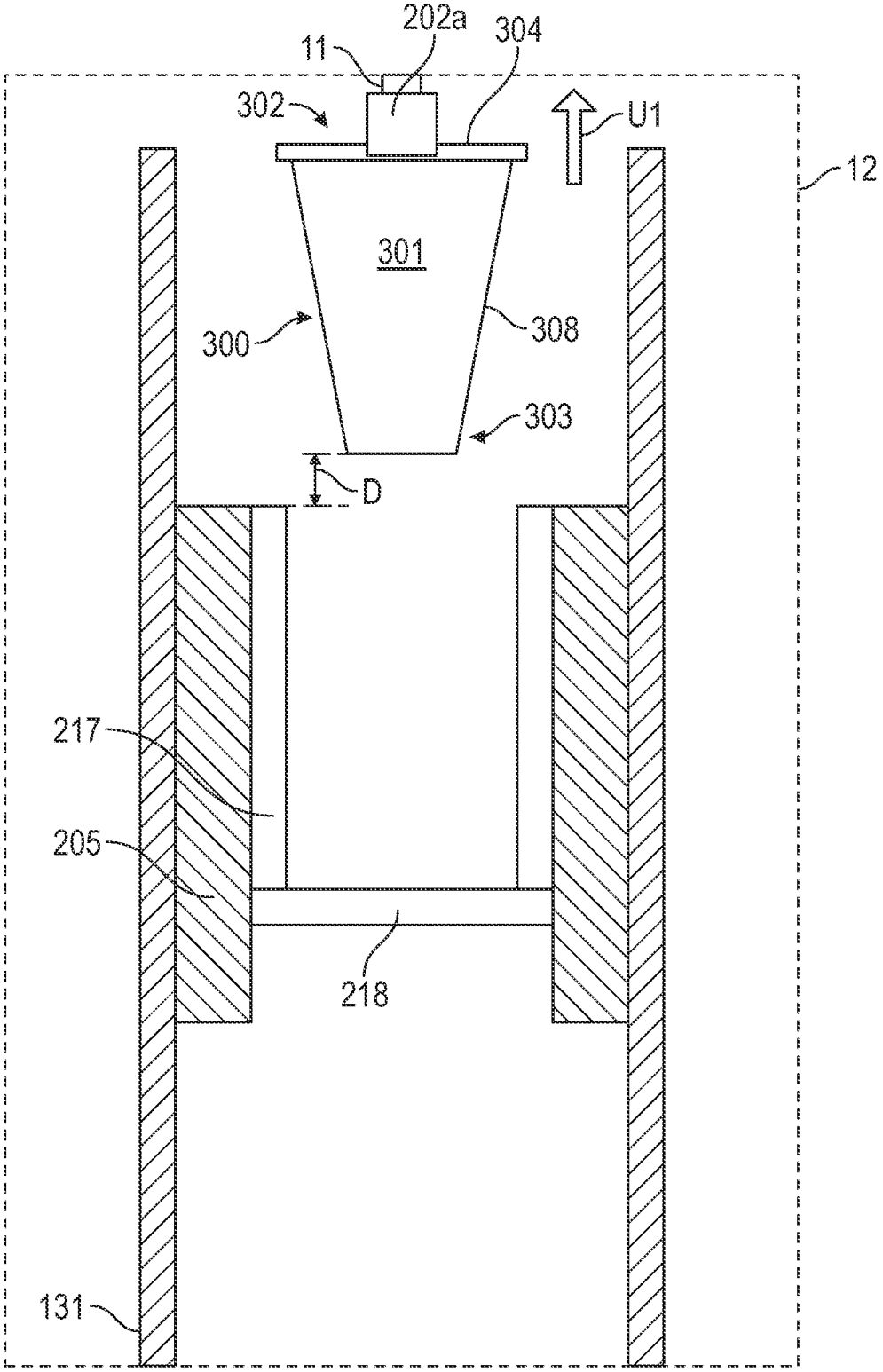

FIG. 14 illustrates a closeup cross-sectional view of the dotted box 14 of FIG. 13. As previously described, the flapper holder tool 300 is deployed and lowered down the production tubing 131 via the cable 11 to reach the TRSSSV 205. Once the flapper holder tool 300 reaches the TRSSSV 205, the cable 11 is pulled upward (see arrow U1) to pick up the flapper holder tool 300 a distance D above the TRSSSV 205. For example, the distance may be 10 feet such that the flapper holder tool 300 is not engaged with the TRSSSV 205. With the flapper holder tool 300 lifted above the TRSSSV 205, a weight on the cable 11 holding the flapper holder tool 300 is measured. The weight on the cable 11 with the flapper holder tool 300 hanging thereof is recorded and stored.

Figure 15:
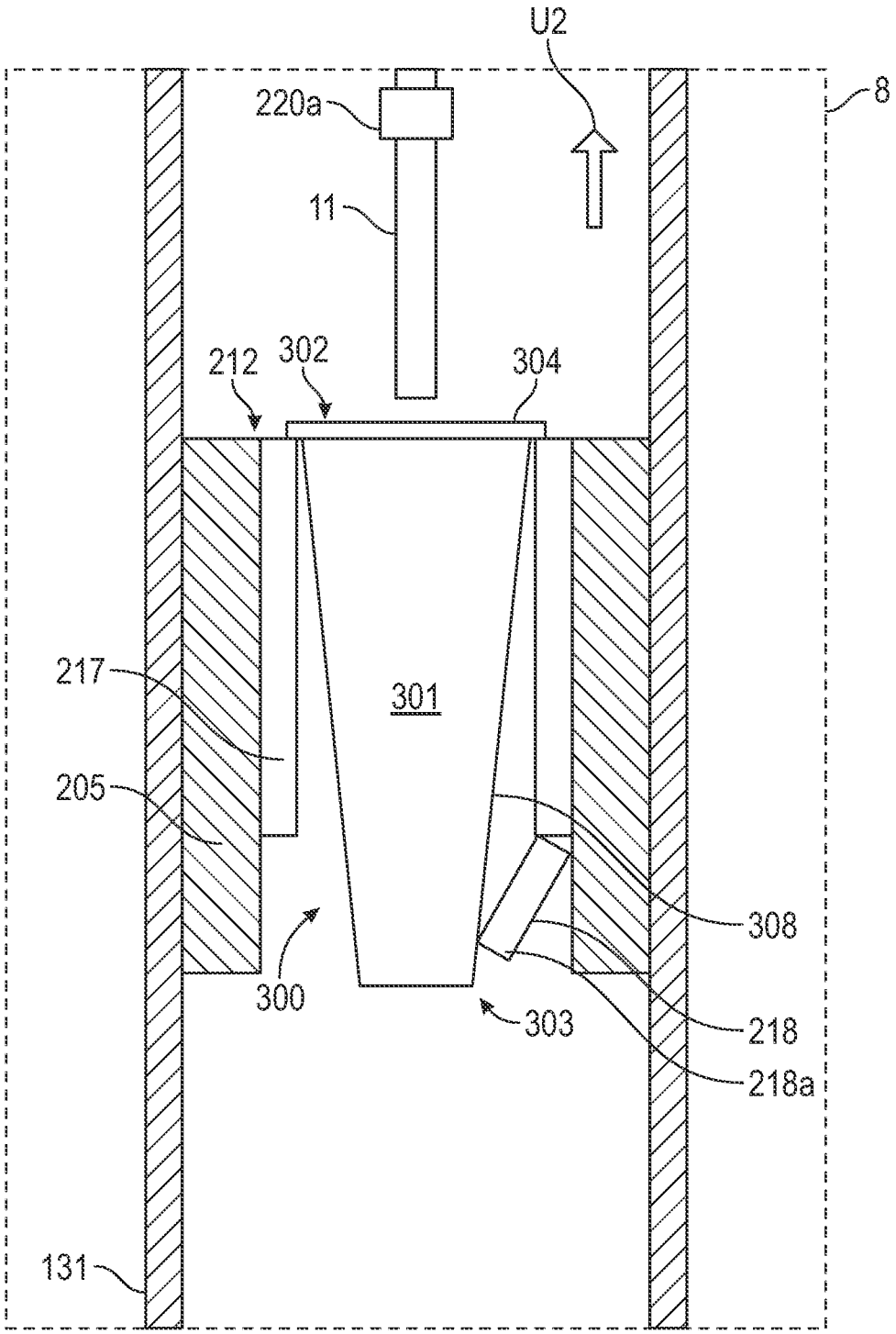

Now referring to FIG. 15, with the weight on the cable 11 with the flapper holder tool 300 measured, the flapper holder tool 300 is lowered to move the flapper (218) back to the open position. For example, the flapper holder tool 300 is jarred down to shear off the running tool 220*a* and the lip 304 of the flapper holder tool 300 at the first end 302 lands on the TRSSSV 205 (i.e., the no-go point). For example, the lip 304 sits on the second end 212 (i.e., an upper most end) of the TRSSSV 205. From the first end 302, the tubular body 301 extends downward such that the second end 303 forces that the flapper 218 to the open position. Additionally, the flapper 218 is contacting the outer surface 308 of the tubular body 301. In some embodiments, a coating on the outer surface 308 reduces a friction between the flapper 218 and the tubular body 301.

In one or more embodiments, the cable 11 may be pulled upward (see arrow U2) and a weight being pulled is measured. The measured weight is then compared to the weight of the cable 11 with the flapper holder tool 300 to ensure that the flapper holder tool 300 has been set on the TRSSSV 205 (i.e., the measured weight should be less than the weight of the cable 11 with the flapper holder tool 300). It is further envisioned that a pressure gauge at the wellhead (103) may provide continuously readings to confirm the TRSSSV 205 is opened. For example, if a pressure gauge records an increase in pressure, this indicates that the pressure within the wellbore (130) is returning back to the wellbore pressure when the TRSSSV 205 open.

Figure 16:
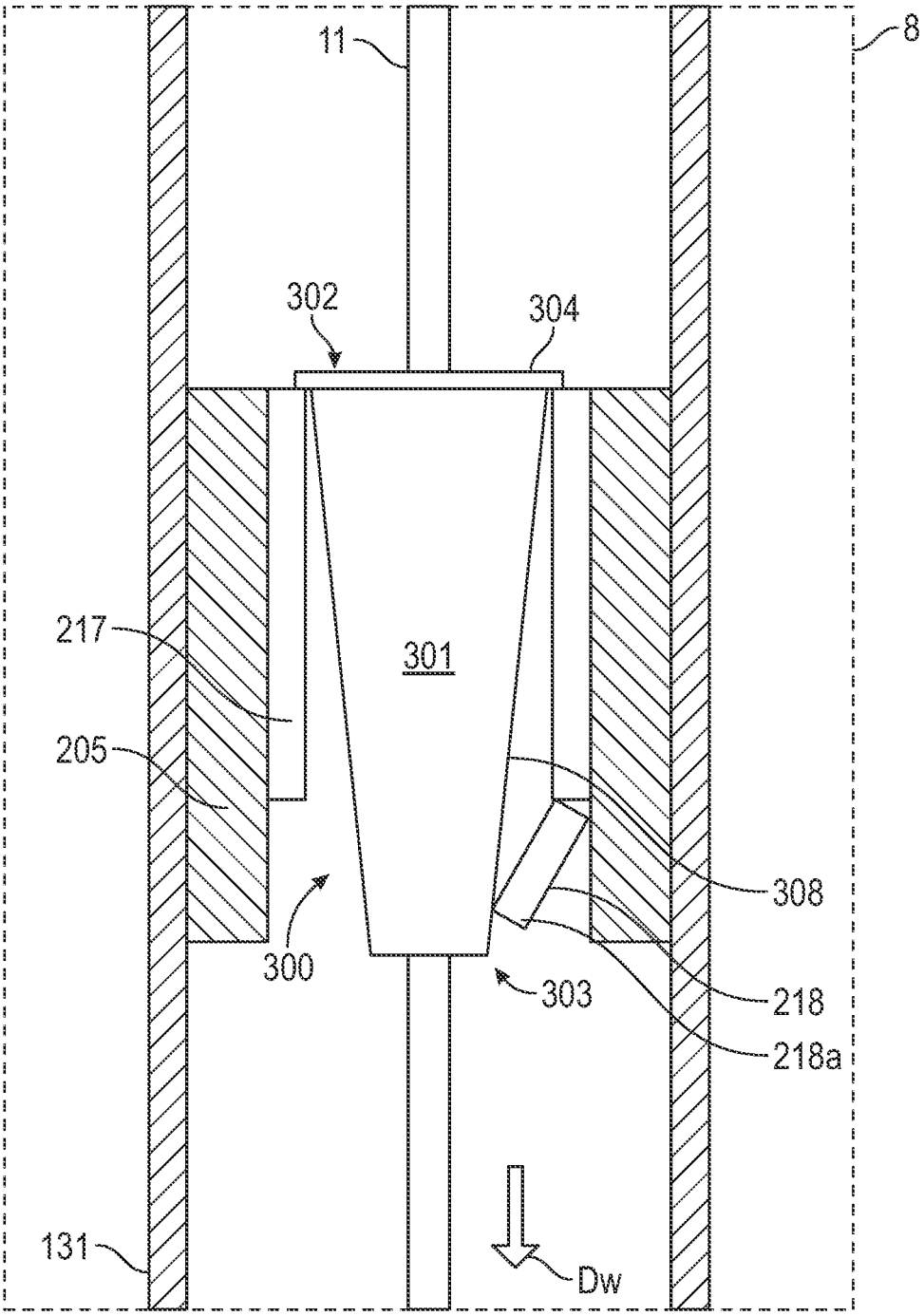

Now referring to FIG. 16, with the flapper 218 back in the open position, well intervention operations may continue. For example, the cable 11 may be lowered (see arrow Dw) through the flapper holder tool 300 and exit below the TRSSSV 205.

Figure 17:
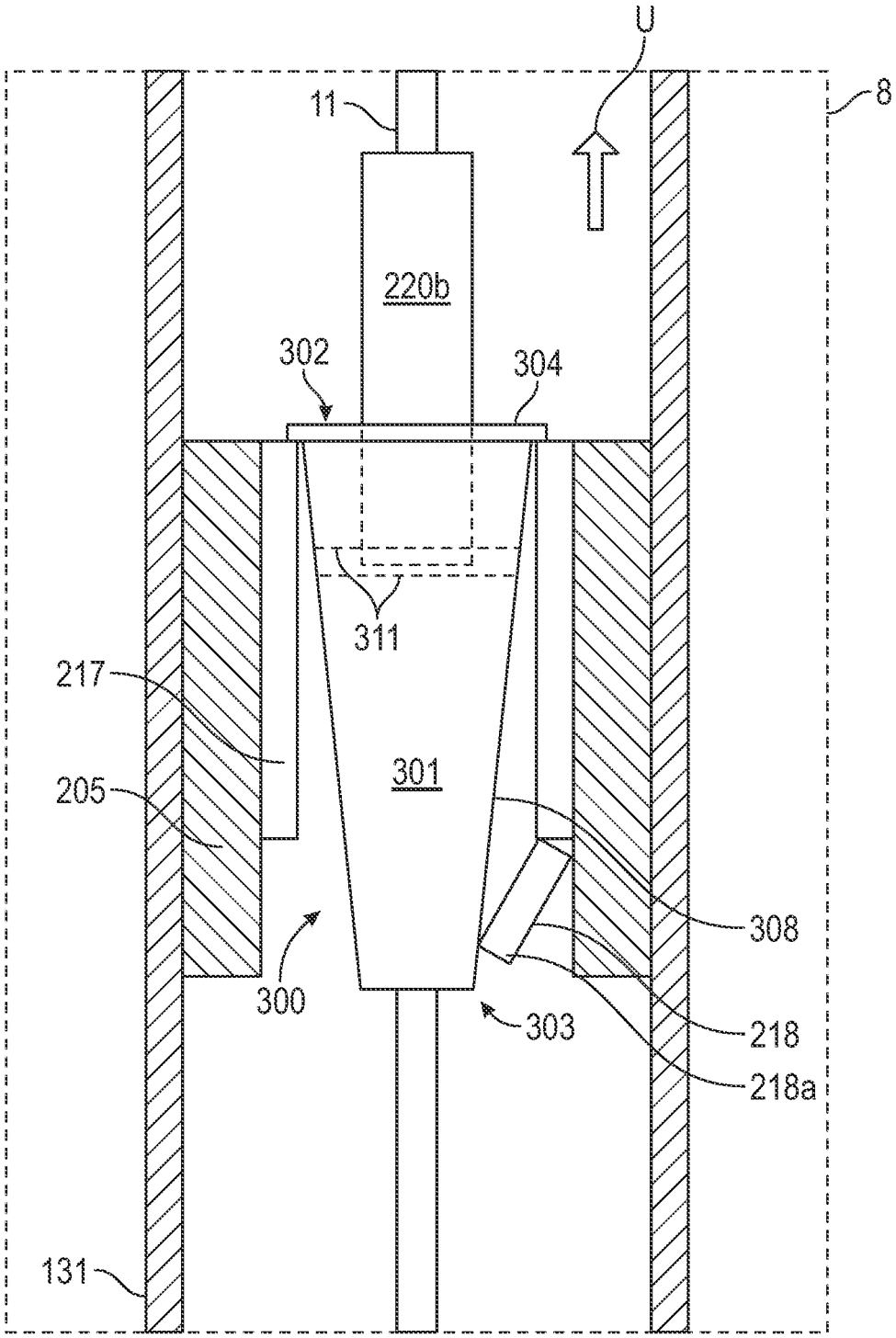

Now referring to FIG. 17, with the flapper holder tool 300 landed on the TRSSSV 205 and moving the flapper 218 to the open position, a pulling tool 220*b* may be sent into the wellbore 130 to retrieve the flapper holder tool 300 and/or the BHA 6. The pulling tool 220*b* may be lowered into the first end 302 to engage the internal fish neck 311. Once engaged with the internal fish neck 311, the pulling tool 220*b* may be move upward (see block Arrow U) via the cable 11 to retrieve the flapper holder tool 300 and/or the BHA 6. As the BHA 6 travels upward, the BHA 6 will engage the flapper holder tool 300. The BHA 6 and the flapper holder tool 300 may be raised together to the surface (108) for maintenance, repairs, or replacement.

In case of TRSSSV failure, according to embodiments herein, a method and system for utilizing a flapper holder tool is deployed to open the TRSSSV. By using the flapper holder tool, well control is achieved in the case where the TRSSSV fails. Additionally, using the flapper holder tool according to embodiments herein avoids losing tools downhole and cutting the wireline, slickline, or coiled tubing. Overall, in the case where the TRSSSV fails, using the flapper holder tool to open the TRSSSV may minimize the need for fishing operations and can return the well to service faster to significantly improve the operational safety, reliability, and longevity during drilling, completion, well intervention, and work-over operations.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A method for a well intervention operation on a wellbore having a tubing-retrievable subsurface safety valve (TRSSSV) in a tubular string therein extending into the wellbore from a wellhead, the TRSSSV including a flapper, the method comprising:

deploying a flapper holder tool into the wellbore;

the flapper holder tool including a tubular body that:

defines a bore extending a length from a first end to a second end;

is tapered from the first end to the second end; and is a rigid member made of a material sufficient to provide a force to push open the flapper of the TRSSSV;

landing a lip of the flapper holder tool within the TRSSSV;

forcing the flapper of the TRSSSV with the tubular body of the flapper holder tool from a closed position to an open position; and conducting the well intervention operation.

2. The method of claim 1, wherein deploying the flapper holder tool into the wellbore further comprises:

closing a valve of a blowout preventer stacked on top of the wellhead;

attaching the flapper holder tool to a cable above the blowout preventer;

equalizing a pressure between the blowout preventer and a lubricator positioned above the blowout preventer;

opening the valve of the blowout preventer; and via the cable, lowering the flapper holder tool down the wellbore through the blowout preventer and the wellhead.

3. The method of claim 1, further comprising sealing the lip on an inner surface of the TRSSSV.

4. The method of claim 1, wherein forcing the flapper of the TRSSSV with the tubular body of the flapper holder tool to the open position further comprises:

contacting the flapper with an end of the tubular body; and applying a downward force with the tubular body.

5. The method of claim 1, wherein conducting the well intervention operation further comprises:

retrieving a bottomhole assembly to a surface via a cable;

engaging an internal fish neck of the flapper holder tool with a pulling tool; and retrieving the flapper holder tool to the surface via the pulling tool.

6. The method of claim 1, wherein deploying the flapper holder tool into the wellbore further comprises:

closing a valve of a blowout preventer stacked on top of the wellhead;

equalizing a pressure between the blowout preventer and a lubricator positioned above the blowout preventer;

opening the valve of the blowout preventer; and dropping the flapper holder tool down the wellbore through the blowout preventer and the wellhead.

7. A flapper holder tool, comprising:

a tubular body that:

defines a bore extending a length from a first end to a second end;

is tapered from the first end to the second end; and is a rigid member made of a material sufficient to provide a force to push open a flapper of a tubing-retrievable subsurface safety valve TRSSSV;

a lip extending radially outward at the first end; and an internal fish neck provided on an inner surface of the tubular body, wherein the second end of the tubular body is configured to engage the flapper of the TRSSSV.

8. The flapper holder tool of claim 7, wherein an inner diameter at the first end is larger than an inner diameter at the second end such that the tubular body is tapered from the first end to the second end.

9. The flapper holder tool of claim 7, wherein the internal fish neck is one or more grooves or notches defined in the inner surface.

10. The flapper holder tool of claim 7, further comprising an opening defined in the tubular body, wherein the opening is configured to receive a cable.

11. A system, comprising:

a wellhead on a surface of a wellbore, wherein a blowout preventer is disposed on top of the wellhead;

a tubing string disposed within the wellbore;

a cable extending downward into the wellbore from the blowout preventer and the wellhead, wherein the cable is connected to a bottomhole assembly within the wellbore;

a tubing-retrievable subsurface safety valve (TRSSSV) disposed in the tubing string; and a flapper holder tool comprising:

a tubular body that:

defines a bore extending a length from a first end to a second end;

is tapered from the first end to the second end; and is a rigid member made of a material sufficient to provide a force to push open a flapper of the TRSSSV; and a lip extending radially outward at the first end configured to land within the TRSSSV, wherein the second end of the tubular body is configured to force the flapper of the TRSSSV to move from a closed position to an open position.

12. The system of claim 11, wherein the second end comprises an engagement surface to contact the flapper.

13. The system of claim 11, wherein the tubular body further comprises an internal fish neck configured to engage a pulling tool.

14. The system of claim 11, wherein the tubular body further comprises an opening to receive the cable.

15. The system of claim 11, wherein the flapper holder tool is configured to be lowered into the wellbore when the tubing-retrievable subsurface safety valve has failed and the flapper is closed.

16. The system of claim 11, wherein the tubular body further comprises a tapered outer surface configured to keep the flapper open.

17. The system of claim 11, further comprising a lubricator disposed on top of the blowout preventer.

* * * * *